US007120522B2

(12) United States Patent
Kau

(10) Patent No.: US 7,120,522 B2
(45) Date of Patent: Oct. 10, 2006

(54) ALIGNMENT OF A FLIGHT VEHICLE BASED ON RECURSIVE MATRIX INVERSION

(75) Inventor: Shing P. Kau, Seminole, FL (US)

(73) Assignee: Honeywell International Inc., Morristown, NJ (US)

( * ) Notice: Subject to any disclaimer, the term of this patent is extended or adjusted under 35 U.S.C. 154(b) by 281 days.

(21) Appl. No.: 10/827,229

(22) Filed: Apr. 19, 2004

(65) Prior Publication Data

US 2005/0234605 A1 Oct. 20, 2005

(51) Int. Cl.
*F41G 3/32* (2006.01)
*G01C 21/16* (2006.01)

(52) U.S. Cl. ..... 701/3; 701/4; 701/14; 701/221; 250/559.3; 244/177

(58) Field of Classification Search ..... 701/3, 701/4, 14, 213, 220, 215, 221; 33/286, 645; 250/553, 559.3, 559.39; 244/3.1, 3.21, 177; 342/62, 357.17
See application file for complete search history.

(56) References Cited

U.S. PATENT DOCUMENTS 4,012,989 A 3/1977 Hunt et al.
5,438,404 A 8/1995 Hamilton et al.
5,619,323 A 4/1997 Hamilton et al.
5,672,872 A 9/1997 Wu et al.
5,809,457 A * 9/1998 Yee et al. ..... 701/220
6,205,400 B1 * 3/2001 Lin ..... 701/214
6,496,778 B1 * 12/2002 Lin ..... 701/215
6,714,866 B1 * 3/2004 Jones et al. ..... 701/220

FOREIGN PATENT DOCUMENTS

EP 0744 590 11/1996
RU 2 215 994 11/2003

* cited by examiner

*Primary Examiner*—Tan Q. Nguyen
(74) *Attorney, Agent, or Firm*—Fogg and Associates, LLC; David N. Fogg

(57) ABSTRACT

A method for recursively determining alignment of a flight vehicle during flight is provided. The method includes generating data in a reference coordinate frame and in a second coordinate frame at a plurality of points in time during the flight, recursively generating first and second matrices from the data in the reference coordinate frame and the second coordinate frame, and at each point in time, determining an alignment output based on the inverted first matrix and the second matrix.

32 Claims, 1 Drawing Sheet

ALIGNMENT OF A FLIGHT VEHICLE BASED ON RECURSIVE MATRIX INVERSION

BACKGROUND INFORMATION

Weapons systems have been developed that include reentry bodies that with guidance and navigation systems to control reentry of the body after separation from a launch vehicle. To accurately control the trajectory of the reentry body, the guidance and navigation system of the reentry body uses position, velocity and orientation information. Typically, the reentry body has an inertial measurement unit (IMU) to provide data to the guidance and navigation system during reentry.

The launch vehicle typically also has a guidance and navigation system along with appropriate sensors, e.g., an IMU, etc. The IMU in the launch vehicle has its own reference frame; commonly called the inertial frame (I-frame). Similarly, the IMU in the reentry vehicle has its own reference frame; commonly referred to as the pseudo-inertial frame (P-frame). To allow the reentry vehicle to properly navigate after separation from the launch vehicle, flight systems commonly determine the orientation of the P-frame with respect to the I-frame using, e.g., a Kalman filter. The Kalman filter outputs information used by the reentry body's navigation computer to determine the vehicle position and velocity in the reference I-frame.

Unfortunately, the Kalman filter is complex and difficult to implement. Specifically, the Kalman filter requires an initial estimate of the relative orientations of the I-frame and P-frame such that the small angle approximation is valid. A poor initial estimate could lead to divergence of the Kalman filter even when there is complete observability of the relative orientations.

Therefore, there is a need in the art for an alignment mechanism in a flight vehicle that does not require an a priori estimate that is good enough for the small angle approximation to be valid.

SUMMARY

Embodiments of the present invention provide an improved alignment mechanism for flight vehicles. The alignment mechanism is based on a recursive matrix inversion algorithm. In one embodiment, the algorithm uses a weighting function to improve performance. In one embodiment, the weighting function is based on the magnitude of the cross product between the pseudo position and velocity vector and, in another embodiment, the weighting function includes the angular separation between these vectors.

In one embodiment, a method for recursively determining alignment of a flight vehicle during flight is provided. The method includes generating data in a reference coordinate frame and in a second coordinate frame at a plurality of points in time during the flight, recursively generating first and second matrices from the data in the reference coordinate frame and the second coordinate frame, and at each point in time, determining an alignment output based on the inverted first matrix and the second matrix.

DETAILED DESCRIPTION

Figure 1:
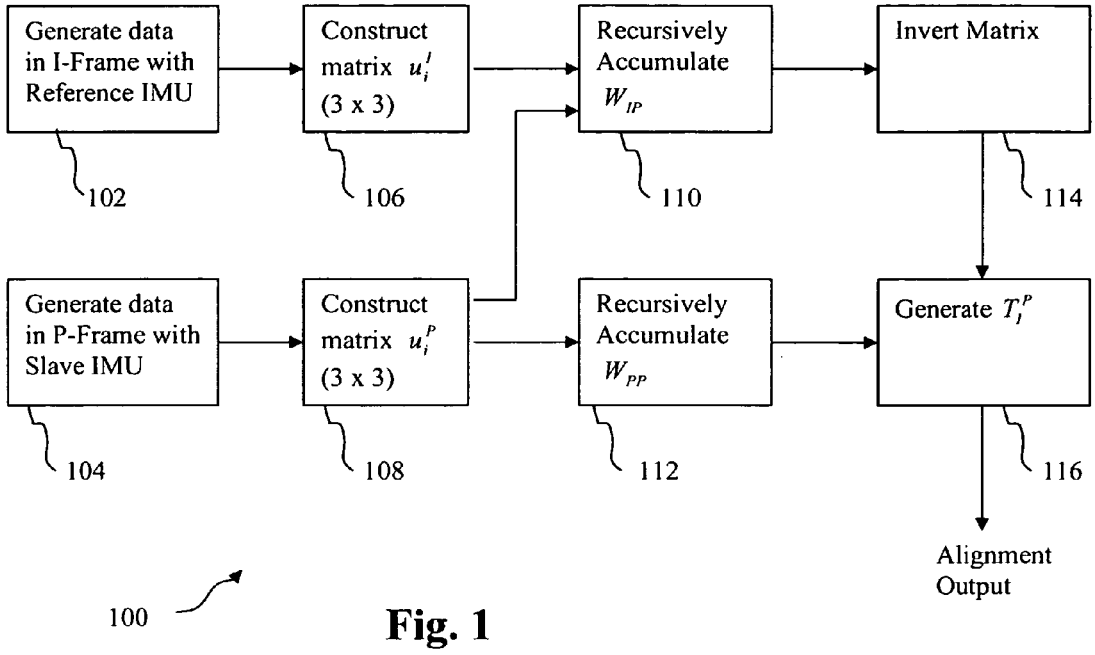
FIG. 1 is a data flow diagram of one embodiment of a process for determining alignment of a flight vehicle based on recursive matrix inversion.

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

1. Introduction

Embodiments of the present invention use a recursive matrix inversion based algorithm to align, for example, the P-frame of a reentry body with the I-frame of a launch vehicle. Advantageously, the recursive matrix inversion based algorithm does not assume a small angle approximation. Further, it also does not require an a priori estimate that is good enough for the small angle approximation to be valid. Hence, the performance of the algorithm is determined by the observability rather than the quality of the a priori estimate. This is an improvement over existing systems using a Kalman filter since, with the Kalman filter, a poor initial estimate could lead to divergence of the filter even when there is complete observability.

2. Generalized Formulation

To derive the alignment algorithm, let $$u_i^I = \lfloor a_i^I, b_i^I, a_i^I \times b_i^I \rfloor \tag{1}$$

and $$u_i^P = \lfloor a_i^P, b_i^P, a_i^P \times b_i^P \rfloor \tag{2}$$

where a and b are orthogonal unit vectors.

Further define the block matrixes, $$U_N^I = \lfloor u_1^I \;\; u_2^I \;\; \ldots \;\; u_N^I \rfloor \tag{3}$$

and $$\begin{aligned} U_N^P &= \lfloor u_1^P \;\; u_2^P \;\; \ldots \;\; u_N^P \rfloor \\ &= T_I^P \lfloor u_1^P \;\; u_2^P \;\; \ldots \;\; u_N^P \rfloor = T_I^P U_N^I \end{aligned} \tag{4}$$

Notice that $U_N^I$ and $U_N^P$ are 3×3N matrixes. $T_I^P$ is a matrix that defines the transformation from the I-frame to the P-frame. In one embodiment, the $T_I^P$ matrix is a direction cosine matrix defining the orientation of the P-frame with respect to the I-frame. Here the P-frame is the unknown to be solved. The I-frame is the known reference frame. The $T^{IP}$ matrix is used in the navigation computer of a reentry body to determine the vehicle position and velocity in the I-frame. Essentially, this $T_I^P$ matrix produces the same output as a Kalman filter.

Construct the 3×3 matrixes, $$W_{PP}(N) = U_N^P (U_N^P)^T \tag{5}$$

and $$W_{IP}(N) = U_N^I (U_N^P)^T \tag{6}$$

The I-to-P transformation matrix can be obtained by matrix inversion, $$T_I^P(N)=W_{PP}(N)W_{IP}^{-1}(N) \tag{7}$$

3. Recursive Formulation

The above equations will be expressed in a recursive form to facilitate a software implementation. It is understood, however, that the mechanism described herein can also be implemented in hardware, firmware or any appropriate combination of hardware, software or firmware.

By definition, $$U_{N+1}^I=[u_1^I u_2^I - - - u_N^I u_{N+1}^I]=[U_N^I u_{N+1}^I] \tag{8}$$

Hence, $$W_{PP}(N+1)=U_{N+1}^P(U_{N+1}^P)^T=[U_N^P u_{N+1}^P][U_N^P u_{N+1}^P]^T=Q_{PP}(N)+u_{N+1}^P(u_{N+1}^P)^T \tag{9}$$

Similarly, $$W_{IP}(N+1)=W_{IP}(N)+u_{N+1}^I(u_{N+1}^P)^T \tag{10}$$

The I-to-P transformation matrix that represents the P-frame alignment with respect to the I-frame, can be solved through inverting a 3×3 matrix as follows, $$T_I^P(N+1)=W_{PP}(N+1)W_{IP}^{-1}(N+1) \tag{11}$$

4. Choice of a and b Vectors

The alignment algorithm developed above involves the computation of the orthogonal unit vectors a and b using IMU measurements of the reentry body in the P-frame and measurements from a reference system in the I-frame. The orthogonal unit vectors could be the sensed acceleration and angular rate with the reference being the nominal trajectory. For better accuracy, the reference system could be the based on outputs of the IMU in the launch vehicle. Typically, the IMU in the launch vehicle is a stabilized platform mechanization. In one embodiment, angular rate is derived from gimbal resolver data. For concept evaluation, an algorithm evaluation test bed was developed using existing flight data from prior missile tests.

5. Weighting Functions

Figure 2:
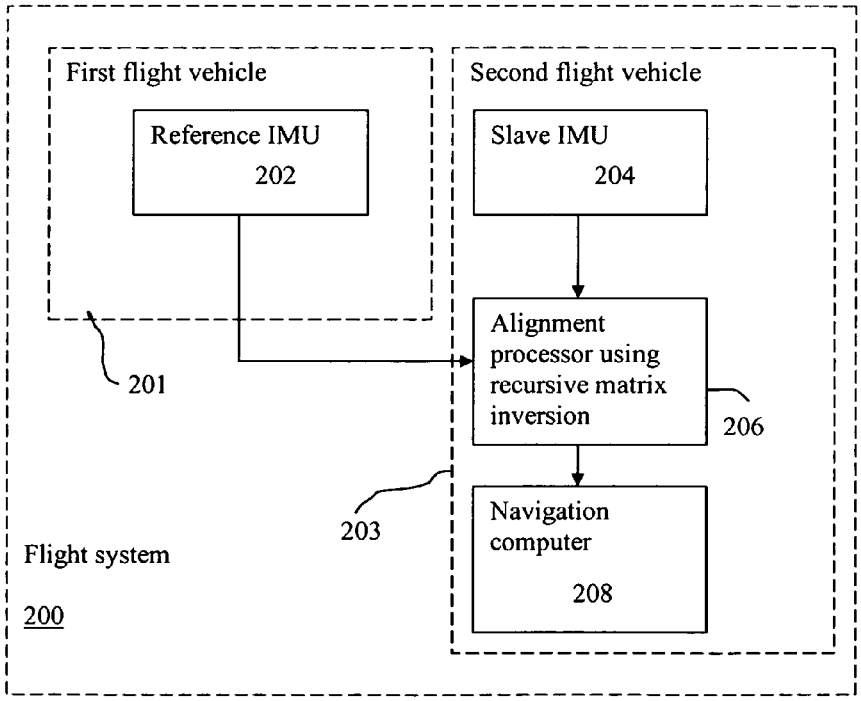
FIG. 2 is a block diagram of one embodiment of a system that determines alignment of a flight vehicle based on recursive matrix inversion.

The performance characteristics presented in FIG. 1 and the trajectory characteristics presented in FIGS. 2 and 3, suggest not all the data are not equally useful in providing the alignment information. Thus, in one embodiment, the alignment algorithm uses weighting on the data. Equations (9), (10), and (11) derived above become, $$W_{PP}(N+1)=U_{N+1}^P(U_{N+1}^P)^T=[U_N^P w_{N+1}u_{N+1}^P][U_N^P w_{N+1}u_{N+1}^P]^T=W_{PP}(N)+w_{N+1}^2u_{N+1}^P(u_{N+1}^P)^T \tag{13}$$

where $w_{N+1}^2$ is the weighting function assigned to the data available at time $t_{N+1}$ Similarly, $$W_{IP}(N+1)=W_{IP}(N)+w_{N+1}^2u_{N+1}^I(u_{N+1}^P)^T \tag{1}$$

The I-to-P transformation matrix that represents the P-frame alignment with respect to the I-frame, remain the same as follows, $$T_I^P(N+1)=W_{PP}(N+1)W_{IP}^{-1}(N+1) \tag{15}$$

6. Implementation System

FIG. 1 is a data flow diagram of one embodiment of a process indicated generally at 100 for determining alignment of a flight vehicle based on recursive matrix inversion. The process generates data in an I-frame from a reference IMU at block 102. Typically, the reference IMU is located on a launch vehicle. The data is typically pseudo position and velocity data although other data could also be used as described above. At block 104, similar data is generated in the P-frame with a slave IMU, e.g., an IMU located on a reentry body. In one embodiment, the data at block 102 and 104 is generated every 1 second during at least a portion of the light. In other embodiments, other appropriate time intervals are used.

At blocks 106 and 108, matrices are constructed in the I and P frames, respectively, based on the data generated in blocks 102 and 104. These matrices are 3×3 matrices as defined in equations (3) and (4) above.

At blocks 110 and 112, the process recursively accumulates matrices $W_{IP}$ and $W_{PP}$. In one embodiment, the $W_{IP}$ matrix is developed recursively according to one of equations (10) and (30) above. Further, the $W_{PP}$ matrix is similarly developed according to one of equations (9) and (29) above. In one embodiment, the weighting function used with equations (30) and (29) is the sine of the angular separation between the pseudo position and velocity. In other embodiments, the weighting function is based on the magnitude of the angular separation between the pseudo position and velocity vectors.

At block 114, the process inverts the $W_{IP}$ matrix is inverted. Further, at block 116, the I frame to P frame transformation matrix is calculated based on one of equations (1) and (15). In one embodiment, this matrix represents a direction cosine matrix which defines the orientation of the P-frame with respect to the I-frame. This matrix is used in a navigation computer to determine the position and velocity of a reentry body in the reference I-frame.

FIG. 2 is a block diagram of one embodiment of a flight system, indicated generally at 200, that determines alignment of a flight vehicle based on recursive matrix inversion. In one embodiment, the flight system 200 includes a first flight vehicle 201, e.g., a launch vehicle, and a second flight vehicle 203, e.g., a reentry body. First flight vehicle 201 includes a master inertial measurement unit (IMU) 202 that generates data in a reference frame commonly referred to as the I-frame. The second flight vehicle 203 includes slave IMU 204 that generates data in a second coordinate frame referred to as the P-frame.

The second flight vehicle 203 processes data from the reference IMU 202 and the slave IMU 204 at a selected interval, e.g., every second, to determine the relationship between the I and P frames. This processing is performed in alignment processor using recursive matrix inversion 206. In one embodiment, the alignment processor 206 implements equations (9)–(11) above to determine the relationship between the I and P frames. In other embodiments, the alignment processor uses the relationship in equations (13)–(15) to determine the relationship between the I and P frames. The output of the alignment processor 206 is fed to the navigation computer 208 of the second flight vehicle 203, e.g., a reentry body, for use in controlling the trajectory of the reentry body.

The methods and techniques described here may be implemented in digital electronic circuitry, or with a programmable processor (for example, a special-purpose processor or a general-purpose processor such as a computer) firmware, software, or in combinations of them. Apparatus embodying these techniques may include appropriate input and output devices, a programmable processor, and a storage medium tangibly embodying program instructions for execution by the programmable processor. A process embodying these techniques may be performed by a programmable processor executing a program of instructions to perform desired functions by operating on input data and generating appropriate output. The techniques may advantageously be implemented in one or more programs that are executable on a programmable system including at least one programmable processor coupled to receive data and instructions from, and to transmit data and instructions to, a data storage system or "machine readable medium," at least one input device, and at least one output device. Generally, a processor will receive instructions and data from a machine readable medium such as a read-only memory and/or a random access memory. Storage devices or machine readable medium suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and DVD disks. Any of the foregoing may be supplemented by, or incorporated in, specially-designed application-specific integrated circuits (ASICs).

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

What is claimed is:

1. A method for recursively determining alignment of a flight vehicle during flight, the method comprising:

generating two flight dynamics or trajectory data in a reference coordinate frame and in a second coordinate frame at a plurality of points in time during the flight; and at each point in time, constructing a first matrix based on the two flight dynamics or trajectory data in the reference coordinate frame at that time;

constructing a second matrix based on the two flight dynamics or trajectory data in the second coordinate frame at that time;

modifying a first accumulation matrix based on the first matrix and the second matrix;

modifying a second accumulation matrix based on the second matrix;

inverting the first accumulation matrix; and determining an alignment output based on the inverted first accumulation matrix and the second accumulation matrix.

2. The method of claim 1, wherein the first matrix is based on a matrix with the form:

$$u_i^I=[a_i^I, b_i^I, a_i^I \times b_i^I]$$

wherein the vector a is the pseudo position vector and the vector b is the pseudo velocity vector.

3. The method of claim 1, wherein:

modifying the first accumulation matrix further comprises using a weighting function; and modifying the second accumulation matrix further comprises using a weighting function.

4. The method of claim 3, wherein the weighting function comprises the sine of the angular separation between the two flight dynamics or trajectory vectors.

5. The method of claim 1, wherein:

generating flight dynamics or trajectory data in a reference coordinate frame comprises generating flight dynamics or trajectory data using a reference inertial measurement unit (IMU); and generating the flight dynamics or trajectory data in the second coordinate frame comprises generating flight dynamics or trajectory data using a second IMU.

6. The method of claim 1, wherein determining an alignment output comprises determining a direction cosine matrix that defines the orientation of the second coordinate frame with respect to the reference coordinate frame.

7. A method for recursively determining alignment of a reentry body of a flight vehicle during flight, the method comprising:

generating flight dynamics or trajectory data in a reference coordinate frame based on data from a reference inertial measurement unit (IMU) of the flight vehicle;

generating flight dynamics or trajectory data in a second coordinate frame based on data from a second IMU located on the reentry body;

wherein the flight dynamics or trajectory data in the reference coordinate frame and in the second coordinate frame is generated at a plurality of points in time during the flight; and at each point in time, constructing a first matrix based on the flight dynamics or trajectory data in the reference coordinate frame at that time;

constructing a second matrix based on the flight dynamics or trajectory data in the second coordinate frame at that time;

modifying a first accumulation matrix based on the first matrix and the second matrix using a weight based on the sine of the angular separation between the pseudo position and velocity;

modifying a second accumulation matrix based on the second matrix using a weight based on the sine of the angular separation between the pseudo position and velocity;

inverting the first accumulation matrix; and determining a direction cosine matrix defining the orientation of the reference coordinate frame with respect to the second coordinate frame based on the inverted first accumulation matrix and the second accumulation matrix.

8. A method for recursively determining alignment of a flight vehicle during flight, the method comprising:

generating data in a reference coordinate frame and in a second coordinate frame at a plurality of points in time during the flight;

recursively generating first and second matrices from the data in the reference coordinate frame and the second coordinate frame; and at each point in time, determining an alignment output based on the inverted first matrix and the second matrix.

9. The method of claim 8, wherein recursively generating first and second matrices comprises, for each of the plurality of points in time:

constructing a first base matrix based on the data in the reference coordinate frame at the point in time;

constructing a second base matrix based on the data in the second coordinate frame at the point in time;

modifying a first accumulation matrix based on the first and second base matrices;

modifying a second accumulation matrix based on the second base matrix;

providing the first and second accumulation matrices as the first and second matrices.

10. The method of claim 8, wherein determining an alignment output comprises determining a direction cosine matrix that defines the orientation of the second coordinate frame with respect to the first reference coordinate frame.

11. The method of claim 8, wherein generating data in a reference coordinate frame comprises generating pseudo position and velocity data.

12. The method of claim 8, wherein generating data in a reference coordinate frame comprises generating acceleration and angular rate data.

13. The method of claim 8, wherein generating data in a reference coordinate frame comprises generating data from the output of an inertial measurement unit (IMU).

14. A system for controlling alignment during a flight, comprising:

a first flight vehicle having a reference inertial measurement unit with a reference coordinate frame;

a second flight vehicle having a second inertial measurement unit with a second coordinate frame;

an alignment processor, coupled to the reference IMU and the second IMU, the alignment processor adapted to receive data in the reference coordinate frame and in the second coordinate frame at a plurality of points in time from the reference IMU and the second IMU during the flight, recursively generate first and second matrices from the data in the reference coordinate frame and the second coordinate frame, and at each point in time, determine an alignment output based on the inverted first matrix and the second matrix; and a navigation computer, coupled to the processor, that is adapted to receive the alignment output to control the trajectory of the second flight vehicle.

15. The system of claim 14, wherein the second flight vehicle comprises a reentry body.

16. The system of claim 14, wherein the reference IMU and the second IMU produce pseudo position and velocity data.

17. The system of claim 14, wherein the alignment processor produces a direction cosine matrix defining the orientation of the second coordinate frame with respect to the reference coordinate frame.

18. The system of claim 14, wherein alignment processor uses a weighting function in recursively generating the first and second matrices.

19. The system of claim 14, wherein the alignment processor uses a weighting function based on a sine of the angular separation between pseudo position and velocity vectors in recursively generating the first and second matrices.

20. A machine readable medium having instructions for performing a method for recursively determining alignment of a flight vehicle during flight, the method comprising:

generating two flight dynamics or trajectory data in a reference coordinate frame and in a second coordinate frame at a plurality of points in time during the flight; and at each point in time, constructing a first matrix based on the two flight dynamics or trajectory data in the reference coordinate frame at that time;

constructing a second matrix based on the two flight dynamics or trajectory data in the second coordinate frame at that time;

modifying a first accumulation matrix based on the first matrix and the second matrix;

modifying a second accumulation matrix based on the second matrix;

inverting the first accumulation matrix; and determining an alignment output based on the inverted first accumulation matrix and the second accumulation matrix.

21. The machine readable medium of claim 20, wherein the first matrix is based on a matrix with the form:

$$u_i^I=[a_i^I, b_i^I, a_i^I \times b_i^I]$$

wherein the vector a is the pseudo position vector and the vector b is the pseudo velocity vector.

22. The machine readable medium of claim 20, wherein:

modifying the first accumulation matrix further comprises using a weighting function; and modifying the second accumulation matrix further comprises using a weighting function.

23. The machine readable medium of claim 22, wherein the weighting function comprises the sine of the angular separation between the two flight dynamics or trajectory vectors.

24. The machine readable medium of claim 20, wherein:

generating flight dynamics or trajectory data in a reference coordinate frame comprises generating flight dynamics or trajectory data using a reference inertial measurement unit (IMU); and generating the flight dynamics or trajectory data in the second coordinate frame comprises generating flight dynamics or trajectory data using a second IMU.

25. The machine readable medium of claim 20, wherein determining an alignment output comprises determining a direction cosine matrix that defines the orientation of the second coordinate frame with respect to the reference coordinate frame.

26. A machine readable medium having instructions for performing a method for recursively determining alignment of a reentry body of a flight vehicle during flight, the method comprising:

generating flight dynamics or trajectory data in a reference coordinate frame based on data from a reference inertial measurement unit (IMU) of the flight vehicle;

generating flight dynamics or trajectory data in a second coordinate frame based on data from a second IMU located on the reentry body;

wherein the flight dynamics or trajectory data in the reference coordinate frame and in the second coordinate frame is generated at a plurality of points in time during the flight; and at each point in time, constructing a first matrix based on the flight dynamics or trajectory data in the reference coordinate frame at that time;

constructing a second matrix based on the flight dynamics or trajectory data in the second coordinate frame at that time;

modifying a first accumulation matrix based on the first matrix and the second matrix using a weight based on the sine of the angular separation between the pseudo position and velocity;

modifying a second accumulation matrix based on the second matrix using a weight based on the sine of the angular separation between the pseudo position and velocity;

inverting the first accumulation matrix; and determining a direction cosine matrix defining the orientation of the reference coordinate frame with respect to the second coordinate frame based on the inverted first accumulation matrix and the second accumulation matrix.

27. A machine readable medium having instructions for performing a method for recursively determining alignment of a flight vehicle during flight, the method comprising:

generating data in a reference coordinate frame and in a second coordinate frame at a plurality of points in time during the flight;

recursively generating first and second matrices from the data in the reference coordinate frame and the second coordinate frame; and at each point in time, determining an alignment output based on the inverted first matrix and the second matrix.

28. The machine readable medium of claim 27, wherein recursively generating first and second matrices comprises, for each of the plurality of points in time:

constructing a first base matrix based on the data in the reference coordinate frame at the point in time;

constructing a second base matrix based on the data in the second coordinate frame at the point in time;

modifying a first accumulation matrix based on the first and second base matrices;

modifying a second accumulation matrix based on the second base matrix;

providing the first and second accumulation matrices as the first and second matrices.

29. The machine readable medium of claim 27, wherein determining an alignment output comprises determining a direction cosine matrix that defines the orientation of the second coordinate frame with respect to the first reference coordinate frame.

30. The machine readable medium of claim 27, wherein generating data in a reference coordinate frame comprises generating pseudo position and velocity data.

31. The machine readable medium of claim 27, wherein generating data in a reference coordinate frame comprises generating acceleration and angular rate data.

32. The machine readable medium of claim 27, wherein generating data in a reference coordinate frame comprises generating data from the output of an inertial measurement unit (IMU).

* * * * *